US005393455A

United States Patent [19]

Poethkow et al.

[11] Patent Number: 5,393,455

[45] Date of Patent: Feb. 28, 1995

[54] ZEOLITE-BASED PHOSPHATE-FREE DETERGENT BUILDER COMPOSITION

[75] Inventors: Joerg Poethkow, Duesseldorf; Horst Upadek, Ratingen; Eduard Smulders, Hilden, all of Germany

[73] Assignee: Henkel Kommanditgesellschaft auf Aktien, Duesseldorf, Germany

[21] Appl. No.: 39,328

[22] PCT Filed: Oct. 17, 1991

[86] PCT No.: PCT/EP91/01976

§ 371 Date: Apr. 26, 1993

§ 102(e) Date: Apr. 26, 1993

[87] PCT Pub. No.: WO92/07928

PCT Pub. Date: May 14, 1992

[30] Foreign Application Priority Data

Oct. 26, 1990 [DE] Germany ..... 4034131

[51] Int. Cl.[6] ..... C11D 3/12; C11D 3/08; C11D 3/37; C11D 7/60

[52] U.S. Cl. ..... 252/174.25; 252/135; 252/174.24; 252/DIG. 11

[58] Field of Search ..... 252/174.25, 135, 174.24, 252/DIG. 2, DIG. 11

[56] References Cited

U.S. PATENT DOCUMENTS

| | | | |
|---|---|---|---|
| 4,664,839 | 5/1987 | Rieck | 252/175 |
| 4,707,290 | 11/1987 | Seiter et al. | 252/140 |
| 4,820,439 | 4/1989 | Rieck | 252/135 |
| 4,919,845 | 4/1990 | Vogt et al. | 252/526 |
| 4,959,170 | 9/1990 | Ulrich et al. | 252/135 |
| 5,066,415 | 11/1991 | Dany et al. | 252/135 |
| 5,076,957 | 12/1991 | Diehl et al. | 252/174.24 |
| 5,078,895 | 1/1992 | Dany et al. | 252/94 |

FOREIGN PATENT DOCUMENTS

| | | |
|---|---|---|
| 0164514 | 4/1985 | European Pat. Off. . |
| 0337219 | 4/1988 | European Pat. Off. . |
| 0291869 | 5/1988 | European Pat. Off. . |
| 0337217 | 10/1989 | European Pat. Off. . |
| 0368589 | 5/1990 | European Pat. Off. . |
| 0405122 | 1/1991 | European Pat. Off. . |
| 3603471 | 8/1987 | Germany . |

OTHER PUBLICATIONS

"Einsatz von Phosphonaten in flüssigen Vollwaschmitteln", M. Paladini, G. Schnorbus, Seifen-Öle-Fette-Wachse, vol. 114 (1989), pp. 508-511. No Month Available.

"Einsatz von Phosphonaten in Haushaltswaschmitteln mit niedrigem Phosphorgehalt (1%)", M. Paladini, G. Schnorbus, Seifen-Öle-Fette-Wachse, vol. 115 (1988), pp. 756-760. No Month Available.

*Primary Examiner*—Paul Lieberman
*Assistant Examiner*—A. Hertzog
*Attorney, Agent, or Firm*—Ernest G. Szoke; Wayne C. Jaeschke; Real J. Grandmaison

[57] ABSTRACT

Phosphate-free builder combinations containing zeolite, crystalline layer silicates corresponding to formula (I) $NaMSi_xO_{2x+1}\cdot yH_2O$, in which M is sodium or hydrogen, x is a number of 1.9 to 4 and y is a number of 0 to 20, and polymeric polycarboxylates may be used separately as water softeners or in detergents. Their primary and secondary detergent properties are so favorable that there is little or no need to use phosphonates.

15 Claims, No Drawings

ZEOLITE-BASED PHOSPHATE-FREE DETERGENT BUILDER COMPOSITION

FIELD OF THE INVENTION

1. Field of the Invention

This invention relates to a phosphate-free builder combination, to a process for its production and to a detergent containing this builder combination.

In practice, phosphate Substitutes in detergents include, above all, zeolite, particularly zeolite NaA, and mixtures of zeolite with alkali metal silicates and carbonates and also polymeric polycarboxylates. Other phosphate substitutes which have been used are complexing agents, such as the salts of nitrilotriacetic acid (NTA), ethylenediamine tetraacetic acid (EDTA) and phosphonic acids. The function of the complexing agents, most of which have a selective effect, is to eliminate heavy metal ions which, even in traces, have a very unfavourable effect on the washing process (Ullmann, 1987, Vol. 8, pages 351 to 354). It is known that phosphonates also counteract the precipitation of poorly soluble calcium salts and, hence, the incrustation and discoloration of fabrics produced by poorly soluble calcium salts ("Einsatz yon Phosphonaten in flüssigen Vollwaschmitteln", M. Paladini, G. Schnorbus, Seifen-Öle-Fette-Wachse, Vol. 114 (1989), pages 508 to 511). Finally, the combined use of phosphonates and copolymers based on acrylic acid and maleic acid provides the fabrics with greater whiteness by comparison with formulations containing only one of these two components ("Einsatz yon Phosphonaten in Haushaltswaschmitteln mit niedrigem Phosphorgehalt (1%)", M. Paladini, G. Schnorbus, Seifen-Öle-Fette-Wachse, Vol. 115 (1988), pages 756 to 760).

2. Discussion of Related Art

European patent application 291 869 describes phosphate-free builder combinations of zeolite, aminoalkane polyphosphonate, 1-hydroxyethane-1,1-diphosphonate (HEDP) and polymeric polycarboxylate, certain ratios by weight of the last three components showing a synergism in regard to the prevention of fiber incrustations.

Crystalline, layer-form sodium silicates have also been described as substitutes or partial substitutes for phosphates and zeolites. Thus, European patent application 164 514 discloses a phosphate-free builder combination which mainly contains crystalline layer silicates corresponding to formula (I) $NaMSi_xO_{2+1}\cdot_yH_2O$, where M is sodium or hydrogen, x is a number of 1.9 to 4 and y is a number of 0 to 20, preferred values for x being 2, 3 or 4. They may be used as water softeners both separately and in detergents together with other builders, such as phosphates, zeolite, other silicates, phosphonates and polycarboxylates.

European patent applications 337 217 and 337 219 describe builder combinations for detergents which contain crystalline layer silicates corresponding to formula (I) above and, optionally, phosphates and polycarboxylates, such as citrates, gluconates, NTA and/or iminodiacetates, but no zeolite.

DESCRIPTION OF THE INVENTION

The problem addressed by the present invention was further to develop the field of phosphate-builder combinations with a view to reducing the content of organic synthetic compounds. It has surprisingly been found that the combination of fine-particle zeolite, crystalline layer silicate and a certain polymeric polycarboxylate meets the stringent demands imposed on the primary detergent effect and on the secondary properties, more particularly the inhibition of incrustation on fabrics and the prevention of deposits in washing machines, so effectively that there is virtually no need to use phosphonates and, preferably, no need at all to use phosphonates.

In a first embodiment, therefore, the present invention relates to a phosphate-free builder combination containing zeolite, polymeric polycarboxylate and crystalline layer silicate corresponding to formula (I) $NaMSi_xO_{2x+1}\cdot_yH_2O$, where M is sodium or hydrogen, x is a number of 1.9 to 4 and y is a number of 0 to 20, and optionally phosphonates.

In another embodiment, the present invention relates to a detergent containing this phosphate-free builder combination of zeolite, crystalline layer silicates corresponding to formula (I) and polymeric polycarboxylates.

The zeolites are used in the typical hydrated, finely crystalline form. They contain hardly any particles larger than 30 μm in size, at least 80% of the zeolites preferably consisting of particles smaller than 10 μm in size. Their calcium binding power, as determined in accordance with German patent application 24 12 837, is in the range from 100 to 200 mg CaO/g. Zeolite NaA is particularly suitable, although zeolite NaX and mixtures of NaA and NaX may also be used. The builder combinations according to the invention preferably contain 60 to 96% by weight and, more particularly, 65 to 85% by weight hydrated zeolite.

The crystalline layer silicates corresponding to formula (I) are preferably those in which M is sodium and x assumes a value of 2 or 3. Particularly preferred crystalline layer silicates are both β- and δ-sodium disilicates $Na_2Si_2O_5\cdot_yH_2O$. β-Sodium disilicate may be obtained, for example, by the process described in International patent application WO 91/08171. The builder combinations according to the invention preferably contain the crystalline layer silicates in quantities of 2 to 25% by weight and, more preferably, in quantities of 3 to 15% by weight.

Suitable polymeric polycarboxylates are polymeric carboxylic acids having a relative molecular weight of at least 350 in the form of their water-soluble salts, more particularly in the form of the sodium and/or potassium salts, such as polyacrylates, polyhydroxyacrylates, polymethacrylates, polymaleates and, more particularly, copolymers of acrylic acid with maleic acid or maleic anhydride, preferably those of 50 to 90% acrylic acid and 50 to 10% maleic acid. The relative molecular weight of the homopolymers is generally in the range from 1,000 to 100,000 while the relative molecular weight of the copolymers is in the range from 2,000 to 200,000 and preferably in the range from 50,000 to 120,000, based on free acid. A particularly preferred acrylic acid/maleic acid copolymer has a relative molecular weight of 50,000 to 100,000. Suitable, albeit less preferred compounds of this class are copolymers of acrylic acid or methacrylic acid with vinyl ethers, such as vinyl methyl ethers, vinyl esters, ethylene, propylene and styrene, in which the acid makes up at least 50%. The polymeric polycarboxylates preferably make up 2 to 16% by weight and, more preferably, 3 to 14% by weight of the builder combinations.

Preferred builder combinations contain crystalline layer silicates and polymeric polycarboxylates in a ratio by weight of 3:1 to 1:3. Crystalline layer silicates and polymeric polycarboxylates are used with particular advantage in a ratio by weight of 1.5:1 to 1:2.

In one preferred embodiment, the builder combinations according to the invention contain no phosphonates because, even without phosphonates, the builder combinations surprisingly have a synergistic effect in the washing process in regard to the whiteness of the fabrics and improve the stabilization of the peroxy bleach.

Surprisingly, there is also no need to use other complexing agents or polycarboxylates, such as gluconate, EDTA, NTA, citrate or iminodiacetate.

In another preferred embodiment, the products according to the invention additionally contain amorphous, alkaline or neutral alkali metal silicates, more particularly sodium and/or potassium silicates, in which the ratio of $M_2O$ to $SiO_2$ is from 1:1 to 1:3.5. Preferred builder combinations contain alkali metal silicates with an $Na_2O$ to $SiO_2$ ratio of 1:2.0 to 1:3.3 and, more particularly, to 1:3.0. The quantities of amorphous alkali metal silicate to be used are selected so that the ratio by weight of crystalline layer silicate to amorphous alkali metal silicate is between 1.5:1 and 1:2 and more particularly between 1.2:1 and 1:1.7. Builder combinations in which the ratio by weight of crystalline layer silicate to polymeric polycarboxylate to amorphous alkali metal silicate is 1:(0.9–1.5):(1.2–1.5) are used with particular advantage.

The detergents containing the builder combinations according to the invention may be present in solid, liquid or paste-like form. They contain the builder combination preferably in quantities of 31 to 60% by weight and, more preferably, in quantities of 35 to 50% by weight. Preferred detergents contain 20 to 40% by weight and, more particularly, 26 to 35% by weight finely crystalline and hydrated zeolite of the A and/or X type, 1 to 15% by weight and, more particularly, 1.5 to 7% by weight crystalline layer silicates corresponding to formula (I), 1 to 9% by weight and, more particularly, 1.5 to 7% by weight polymeric polycarboxylates and 2 to 10% by weight and, more particularly, 2 to 8% by weight amorphous alkali metal silicates with an $Na_2O$ to $SiO_2$ ratio of 1:2.0 to 1:3.3.

In addition, the detergents may contain up to 10% by weight sodium carbonate. Detergents containing at most up to 5% by weight sodium carbonate are preferred.

The detergents contain known compounds from the group of anionic, nonionic and zwitterionic surfactants as further constituents. Sulfonates and sulfates and also soaps of preferably natural fatty acids or fatty acid mixtures are particularly suitable as the anionic surfactants. $C_{9-13}$ alkylbenzene sulfonates, olefin sulfonates, esters of $\alpha$-sulfofatty acids or $\alpha$-sulfofatty acid disalts, for example, are used as surfactants of the sulfonate type. Suitable surfactants of the sulfate type are the sulfuric acid monoesters of primary alcohols of natural or synthetic origin, i.e. of $C_{12-18}$ fatty alcohols or $C_{10-20}$ oxoalcohols, and those of secondary alcohols having the same chain length. The sulfuric acid monoesters of alcohols reacted with 1 to 6 mol ethylene oxide (EO) are also suitable. Suitable nonionic surfactants are, above all, adducts of preferably 2 to 20 mol EO with 1 mol of an aliphatic compound essentially containing 10 to 20 carbon atoms from the group consisting of alcohols, carboxylic acids, fatty amines, carboxylic acid amides and alkane sulfonamides. In addition to water-soluble nonionic surfactants, however, water-insoluble or substantially water-insoluble polyglycol ethers containing 2 to 7 ethylene glycol ether units in the molecule are important, particularly when they are used together with water-soluble nonionic or anionic surfactants. Other suitable nonionic surfactants are alkyl polyglycosides corresponding to the general formula $R—O—(G)_x$, in which R is a primary, linear or 2-methyl-branched aliphatic radical containing 8 to 22 and preferably 12 to 18 carbon atoms, G is a symbol which stands for a glycose unit containing 5 or 6 carbon atoms and the degree of oligomerization x is between 1 and 10.

The total surfactant content of the detergents is between 5 and 40% by weight, preferably between 5 and 30% by weight and, more preferably, between 8 and 25% by weight.

Other constituents of the detergents, which may make up as much as 60% by weight and preferably from 5 to 50% by weight of the detergents, depending on their composition, include redeposition inhibitors, foam inhibitors, bleaches and bleach activators, optical brighteners, enzymes, fabric softeners, dyes and fragrances and also neutral salts, solvents and water.

Among the compounds yielding $H_2O_2$ in water which are used as bleaches, sodium perborate tetrahydrate ($NaBO_2.H_2O.3H_2O$) and sodium perborate monohydrate ($NaBO_2.H_2O_2$) are particularly important. Other suitable bleaches are, for example, peroxycarbonate ($Na_2CO_3.1.5H_2O_2$) or peracidic salts of organic acids, such as perbenzoates or salts of diperdodecanedioic acid.

To obtain an improved bleaching effect where washing is carried out at temperatures of or below 60° C., bleach activators may be incorporated in the preparations. Examples of suitable bleach activators are the N-acyl or O-acyl compounds which form organic peracids with $H_2O_2$, preferably N,N'-tetraacylated diamines, such as N,N,N',N'-tetraacetyl ethylenediamine.

Suitable enzymes are those from the classes of proteases, lipases and amylases or mixtures thereof. The enzymes may be adsorbed on supports and/or encapsulated in shell-forming substances to protect them against premature decomposition.

Suitable and preferred non-surface-active foam inhibitors are organopolysiloxanes and mixtures thereof with microfine, optionally silanized silica, paraffins, waxes, microcrystalline waxes and mixtures thereof with silanized silica. Mixtures of different foam inhibitors, for example mixtures of silicones and paraffins or waxes, may also be used with advantage. The foam inhibitors are preferably fixed to a granular support soluble or dispersible in water.

In one preferred embodiment, powder-form or granular detergents contain from 10 to 20% by weight surfactants, 26 to 35% by weight zeolite NaA, 2 to 5% by weight crystalline layer silicates corresponding to formula (I), in which M is sodium and x has the value 2, 2 to 5% by weight polymeric polycarboxylates, 2 to 5% by weight amorphous alkali metal silicates and also 15 to 30% by weight bleach and 0.1 to 1% by weight enzyme. The apparent density of the detergents is preferably between 400 and 900 g/l.

Both the builder combinations according to the invention and the detergents according to the invention may be produced by methods known per se, for example by mixing, granulation and/or by spray-drying. In the case of the detergents, separately prepared builder combinations may be used. The various builders may also be incorporated in the detergents individually in known manner and in any order.

The pourable powder-form or granular preparations preferably consist of a dry homogeneous mixture of at least two powder components, of which the first is present in the form of spray-dried granules. The granules may be obtained by conventional spray-drying of a slurry containing zeolite, preferably in the form of an aqueous suspension, in admixture with the sodium salt of the (co)polymeric acids as builders. As is usually the case, bleaches, such as perborate, are not spray-dried together with the constituents of the first powder component on account of their sensitivity to heat, but are subsequently incorporated in the spray-dried product. Any amorphous alkali metal silicates present are also preferably not spray-dried together with the zeolite-containing slurry. Similarly, the crystalline layer silicates are preferably not spray-dried, but instead are incorporated in granular form or adsorbed onto a support consisting of sulfate and/or carbonate.

EXAMPLES

Granular detergents having the composition shown below were prepared and tested. The constituents mentioned in first to sixth place and also zeolite NaA and sodium sulfate were mixed to form an aqueous slurry and spray-dried in a test tower. The perborate, the bleach activator and the granules were subsequently incorporated in the spray-dried product.

Testing was carried out under simulated practical conditions in domestic washing machines. To this end, the machines were loaded with 3.5 kg normally soiled domestic washing (bed linen, table linen, underwear) and 0.5 kg test fabrics. Strips of standardized cotton fabric (Wäscheforschungsanstalt Krefeld), nettle, knitted fabric (cotton tricot) and terry were used as the test fabrics. Washing conditions: tapwater having a hardness of 23.d (equivalent to 230 mg CaO/l), main wash cycle 8.0 g/l at 25° to 90° C. (heating time 60 minutes, 15 minutes at 90° C.), liquor ratio (kg washing:liter wash liquor in the main wash cycle) 1:4, 5× rinsing with tapwater, spinning and drying.

The test fabrics were provided with bleachable and enzyme-degradable soils. The use of the powder detergent containing a builder combination according to the invention produced comparable to better results in regard to whiteness than the powder detergent containing a standard builder combination (measurement of whiteness: Zeiss reflectometer, 465 nm, blanking out of the effect of the brightener).

After 50 wash cycles, the ash content of the fabric samples was quantitatively determined. Averaged out over all the test fabrics, the powder detergent containing the builder combination according to the invention showed comparable to better ash contents than the standard powder detergent.

| Composition | | |
|---|---|---|
| 1. | 7.0% by weight | sodium dodecyl benzenesulfonate |
| 2. | 1.5% by weight | sodium $C_{12-18}$ fatty acid soap |
| 3. | 1.5% by weight | sodium tallow soap |
| 4. | 6.5% by weight | $C_{12-18}$ fatty alcohol containing 5 EO |
| 5. | 0.8% by weight | cellulose ether |
| 6. | 0.2% by weight | optical brightener |
| 7. | 38.5% by weight | builder combination |
| 8. | 26.0% by weight | sodium perborate tetrahydrate |
| 9. | 2.0% by weight | tetraacetyl ethylenediamine (TAED) |
| 10. | 0.5% by weight | granular enzyme |
| 11. | 0.2% by weight | granular silicone foam inhibitor |

-continued

| Composition | |
|---|---|
| balance | sodium sulfate, water |

Builder combination (in % by weight, based on the detergent as a whole)

| | Standard C | Invention I |
|---|---|---|
| Zeolite NaA, hydrated | 31.0 | 31.0 |
| Sodium silicate, amorphous ($Na_2O:SiO_2$=1:3.0) | 3.0 | 3.0 |
| Sokalan CP5 ® (Acrylic acid/maleic acid copolymer, a commercial product of BASF) | 4.0 | 2.5 |
| Na-SkS6 ® (δ-sodium disilicate, a commercial product of Hoechst AG) | — | 2.0 |
| HEDP tetrasodium salt | 0.5 | — |

Stabilization of the peroxide bleach

Washing conditions:

Tapwater, 17.d (equivalent to 170 mg CaO/l),

Main wash cycle at 25°-90° C. (heating time 60 minutes, 15 minutes at 90° C.)

Liquor ratio (kg washing: 1 wash liquor in main wash cycle) 1:4

5× Rinsing with tapwater, spinning and drying,

Dosage of detergent: 140 g

The machines were again loaded with 3.5 kg normally soiled domestic washing and 0.5 kg test fabrics. Strips of standardized cotton fabric (Wäschereiforschungsanstalt Krefeld), of crease-resistant cotton fabric and of a blended fabric of polyester and crease-resistant cotton were used as the test fabrics.

Soils: Grease/pigment soils and bleachable soils, such as red wine, tea, cocoa, blueberry The detergents used were detergents having the above composition containing builder combinations I and C. In this case, however, amorphous sodium silicates with a ratio of $Na_2O$ to $SiO_2$ of 1:2.0 (I1, C1) and 1:2.6 (I2, C2) were used.

The tests were each carried out three times. The remission values shown (measurement: see above) represent the average values of all the measurements.

In another series of tests, 10 ppm divalent copper ions ($Cu^{2+}$ in the form of copper sulfate) were added to the wash liquor in quantities of 10 ppm. In this case, too, the remission values shown represent the average values of all the measurements.

The Table clearly shows that detergents I1, I2, C1 and C2 perform comparably in test series a) (detergent with no added copper). In test series b) (detergent containing 10 ppm $Cu^{2+}$) detergents I1 and I2 according to the invention performed significantly better than C1 and C2 on all soils.

TABLE

| Test series | % Remission for detergents containing the builder combinations | | | |
|---|---|---|---|---|
| | C1 | I1 | C2 | I2 |
| a) Detergent | 78.1 | 77.9 | 77.5 | 77.7 |
| b) Detergent + 10 ppm $Cu^{2+}$ | 54.8 | 64.1 | 55.0 | 69.2 |

We claim:

1. A phosphate-free builder composition consisting essentially of from 60 to 96% by weight of zeolite, from 2 to 16% by weight of polymeric polycarboxylate, and from 2 to 25% by weight of crystalline layer silicate corresponding to formula (I) $NaMSi_xO_{2x+1}\cdot_yH_2O$, wherein M is sodium or hydrogen, x is a number of 1.9 to 4 and y is a number of 0 to 20.

2. A phosphate-free builder composition as in claim 1 wherein said crystalline layer silicate and said polymeric polycarboxylate are present in a ratio by weight of 3:1 to 1:3, M in formula (I) is sodium, and x is the number 2 or 3.

3. A phosphate-free builder composition as in claim 1 further containing amorphous sodium silicates having a ratio of $Na_2O$ to $SiO_2$ of from 1:2.0 to 1:3.3 wherein the ratio by weight of crystalline layer silicate to said amorphous sodium silicate is from 1.5:1 to 1:2.

4. A phosphate-free builder composition as in claim 1 wherein at least 80% of said zeolite has a particle size smaller than 10 μm.

5. A phosphate-free builder composition as in claim 4 wherein said zeolite is selected from the group consisting of zeolite NaA, zeolite NaX and mixtures thereof.

6. A phosphate-free builder composition as in claim 1 wherein said crystalline layer silicate is selected from the group consisting of β-sodium disilicate, δ-sodium disilicate, and mixtures thereof.

7. A phosphate-free builder composition as in claim 1 wherein said polymeric polycarboxylate is selected from the group consisting of polyacrylates, polyhydroxyacrylates, polymethacrylates, polymaleates, and copolymers of acrylic acid with maleic acid or maleic anhydride.

8. A detergent composition containing from 31% to 60% by weight of a phosphate-free builder composition consisting essentially of from 60 to 96% by weight of zeolite, from 2 to 16% by weight of polymeric polycarboxylate, and from 2 to 25% by weight of crystalline layer silicate corresponding to formula (I) $NaMSi_xO_{2x+1}\cdot_yH_2O$, wherein M is sodium or hydrogen, x is a number of 1.9 to 4 and y is a number of 0 to 20.

9. A detergent composition as in claim 8 wherein said crystalline layer silicate and said polymeric polycarboxylate are present in a ratio by weight of 3:1 to 1:3, M in formula (I) is sodium, and x is the number 2 or 3.

10. A detergent composition as in claim 8 further containing amorphous sodium silicates having a ratio of $Na_2$ to $SiO_2$ of from 1:2.0 to 1:3.3 wherein the ratio by weight of crystalline layer silicate to said amorphous sodium silicate is from 1.5:1 to 1:2.

11. A detergent composition as in claim 8 wherein at least 80% of said zeolite has a particle size smaller than 10 um.

12. A detergent composition as in claim 8 wherein said zeolite is selected from the group consisting of zeolite NaA, Zeolite NaX and mixtures thereof.

13. A detergent composition as in claim 8 wherein said crystalline layer silicate is selected from the group consisting of β-sodium disilicate, δ-sodium disilicate, and mixtures thereof.

14. A detergent composition as in claim 8 wherein said polymeric polycarboxylate is selected from the group consisting of polyacrylates, polyhydroxyacrylates, polymethacrylates, polymaleates, and copolymers of acrylic acid with maleic acid or maleic anhydride.

15. A phosphate-free detergent composition consisting essentially of from 20 to 40% by weight of zeolite, from 1 to 15% by weight of crystalline layer silicate corresponding to formula (I) $NaMSi_xO_{2X+1}\cdot_yH_2O$ wherein M is sodium or hydrogen, x is a number of 1.9 to 4 and y is a number of 0 to 20, from 1 to 9% by weight of polymeric polycarboxylate, and from 2 to 8% by weight of amorphous alkali metal silicate having a $Na_2$ to $SiO_2$ ratio of from 1:2.0 to 1:3.3.

* * * * *